US006508672B1

(12) United States Patent
Safai

(10) Patent No.: US 6,508,672 B1
(45) Date of Patent: Jan. 21, 2003

(54) JOINTS FOR FILTER CONNECTOR

(75) Inventor: Sohrab Safai, Laguna Niguel, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/028,539

(22) Filed: Dec. 19, 2001

(51) Int. Cl.[7] ..... H01R 13/66
(52) U.S. Cl. ..... 439/620
(58) Field of Search ..... 439/620; 333/181–185

(56) References Cited

U.S. PATENT DOCUMENTS

| | | | | |
|---|---|---|---|---|
| 3,435,387 A | | 3/1969 | Reinke et al. | 333/79 |
| 3,573,677 A | | 4/1971 | Detar | 333/39 |
| 4,126,370 A | | 11/1978 | Nijman | 339/143 |
| 4,187,481 A | | 2/1980 | Boutros | 333/182 |
| 4,195,272 A | | 3/1980 | Boutros | 333/182 |
| 4,458,220 A | | 7/1984 | Carter et al. | 333/182 |
| 4,494,092 A | | 1/1985 | Griffin | 333/182 |
| 4,729,743 A | | 3/1988 | Farrar et al. | 439/276 |
| 4,741,710 A | | 5/1988 | Hogan et al. | 439/620 |
| 4,940,429 A | | 7/1990 | Chambers et al. | 439/608 |
| 5,023,577 A | * | 6/1991 | Drake | 439/620 |
| 5,032,809 A | * | 7/1991 | Chambers et al. | 439/620 |
| 5,188,543 A | * | 2/1993 | Swift | 439/620 |
| 5,340,334 A | | 8/1994 | Nguyen | 439/620 |
| 5,546,058 A | * | 8/1996 | Azuma et al. | 439/620 |
| 5,838,216 A | | 11/1998 | White et al. | 333/182 |

* cited by examiner

*Primary Examiner*—Gary Paumen
(74) *Attorney, Agent, or Firm*—Roger C. Turner

(57) ABSTRACT

A filter connector (10) that includes a grounded shell (12) with an axis (14), a plurality of contacts (20) extending parallel to the axis, and a pi filter coupled to the contacts, the pi filter including a pair of planar capacitors (40, 42) with holes (50, 66) through which the contacts pass and ferrite beads (44) with holes through which the contacts pass. The invention provides connections between contact locations (104, 120) and conductive layers (80, 82) that extend around each hole of each planar capacitor. A coil spring (100) extends between a conductive layer on a rearward planar capacitor (42) and a shoulder (120) on a contact to establish an electrical connection there while biasing the contact rearwardly (R). A slideable retainer ring (112) is slid along the front end of the contact until it presses rearwardly against a conductive layer (80) on the front planar capacitor (40) and locks to the front portion of the contact at a location (104) that assures compression of the corresponding coil spring.

9 Claims, 3 Drawing Sheets

10A

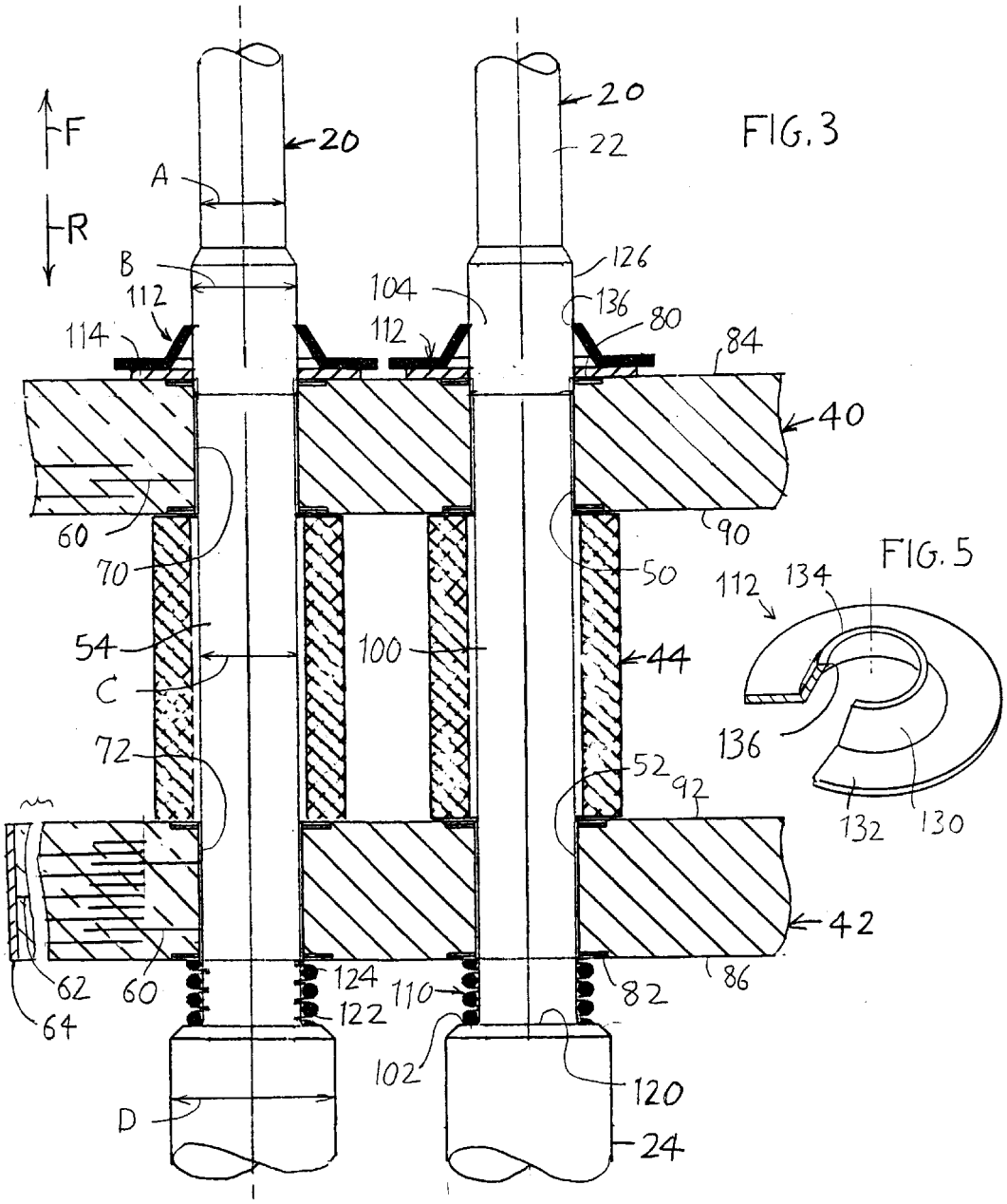
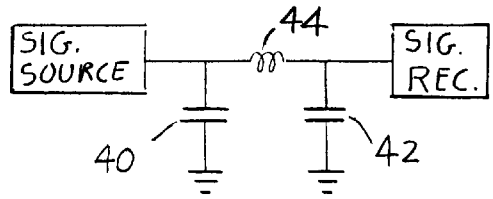
FIG. 4

JOINTS FOR FILTER CONNECTOR

BACKGROUND OF THE INVENTION

Filter connectors are commonly provided with pi filters for the contacts. One pi filter design includes a pair of planar capacitors with holes through which each contact passes and a ferrite bead lying between the planar capacitors and having holes through which the contacts pass. Each planar capacitor has a terminal that must engage a location on the contact in a good electrical connection therewith. One approach is to join each contact location to a planar capacitor by soldering. The soldering is accomplished using solder pre-forms, and by re-flowing through a vapor phase oven. The soldering process is inconsistent and difficult to control due to oven variations and process fluctuations, resulting in high failure rates due to the rigid solder joint construction. Also, failures occur due to different CTE (Coefficient of Thermal Expansion) values of the different materials, resulting in high stresses when the connector is subjected to large temperature changes. Joints for electrically connecting locations along pin contacts to planar capacitors of a filter connector, which resulted in reliable positioning of the contacts and reliable electrical connections between locations along the contacts and the planar capacitors, in a design that enabled easy connection with low cost available components, would be of value.

SUMMARY OF THE INVENTION

In accordance with one embodiment of the present invention, a filter connector is provided, of the type that includes contacts lying within a shell, a pair of planar capacitors within the shell and a plurality of ferrite beads through which the contacts extend. The connector has elements that connect locations along each contact to each planar capacitor in a construction that results in reliable mechanical and electrical connections using low cost and readily available parts that allow disconnection of a single contact, and that allow easy assembly of the parts. Each contact has opposite front and rear portions and a middle portion between them, each middle portion extending through a ferrite bead and through the capacitors. Each contact rear portion has a part of larger diameter than the middle portion to form a forwardly-facing shoulder. A coil spring extending around the middle portion, has one end pressing against the contact shoulder and an opposite end pressing against a conductive layer extending around the hole of the rear planar capacitor. Another location along the contact is connected by a sliding retainer ring to a conductive layer extending around the front capacitor. The sliding ring is slid forwardly along the middle portion until it compresses the coil spring, and then locks the contact in position. The coil spring and retainer ring each provide an electrical and mechanical connection, the coil spring taking up any differential thermal expansion.

The novel features of the invention are set forth with particularity in the appended claims. The invention will be best understood from the following description when read in conjunction with the accompanying drawings.

BRIEF DESCRIPTION OF THE DRAWINGS

FIG. 3 is an enlarged partial sectional view, showing a portion of the connector of FIG. 2.

FIG. 4 is a schematic diagram showing the electrical connector.

FIG. 5 is a partial sectional isometric view of one of the slidable retainer rings of the connector of FIG. 3.

DESCRIPTION OF THE PREFERRED EMBODIMENTS

Figure 1:
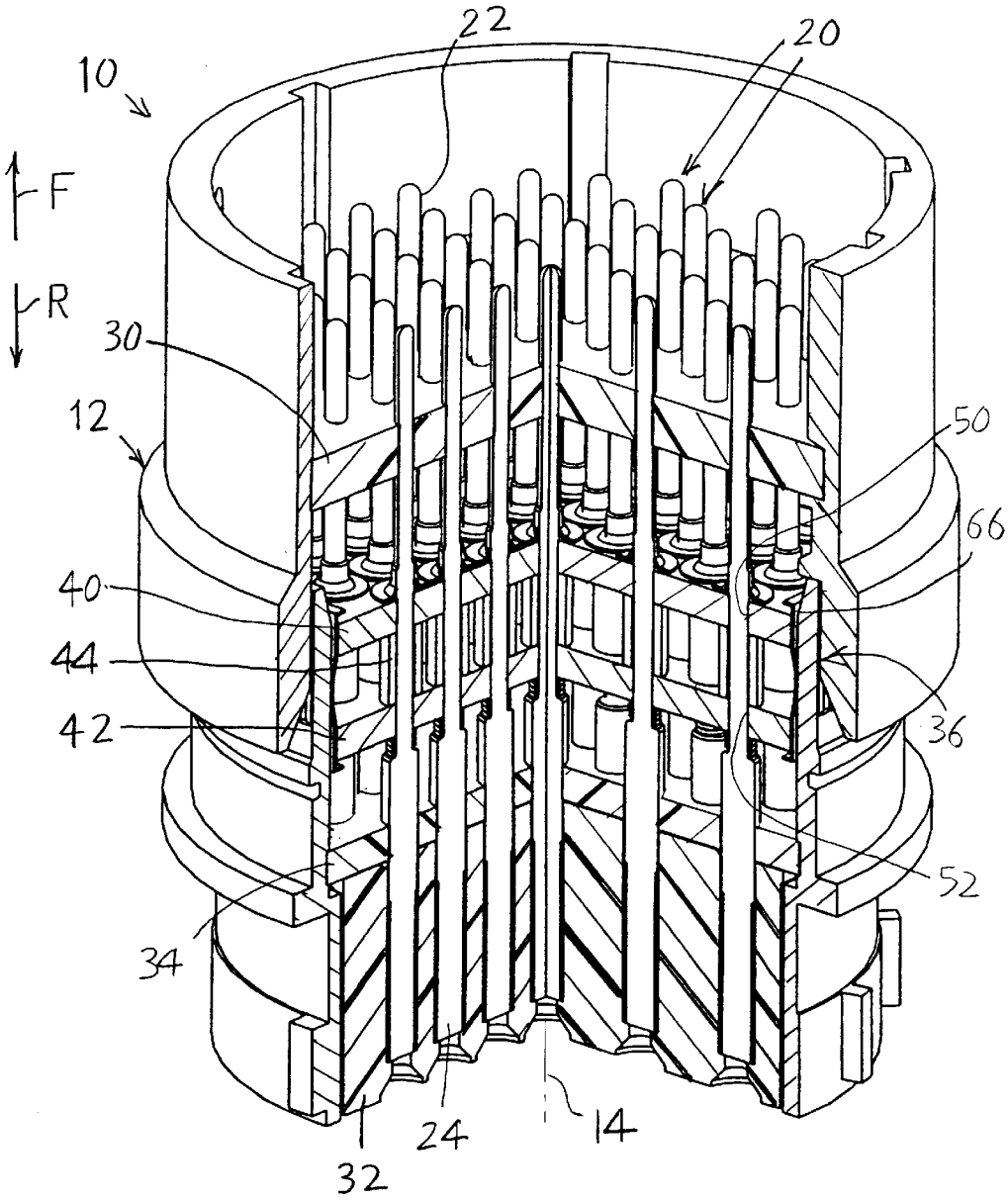
FIG. 1 is a sectional isometric view of a connector of one embodiment of the invention.

FIG. 1 illustrates a filter connector 10 which includes a metal shell 12 with an axis 14 and a plurality of contacts 20 lying in the shell. Each contact has front and rear mating ends 22, 24, the front ends 22 being in the form of pins and the rear ends 24 being in the form of sockets (the sockets are not shown in detail in FIG. 1). A plurality of insulative supports 30, 32, 34 position the mating ends of the contacts.

Noise (usually of higher frequency than the desired signals) passing through the contacts is filtered out by a pi filter which includes a pair of planar capacitor 40, 42 and ferrite beads 44 lying between the planar capacitors. Each planar capacitor has opposite faces that are each normal, or perpendicular, to the axis 14. The planar capacitors have a plurality of aligned pairs of holes 50, 52, and each contact passes through such pair of holes.

FIG. 3 shows that each contact 20 is elongated, and includes the front mating end 22, the rear mating end 24 and a middle contact portion 54 lying between the ends. The middle contact portion extends slightly forward and rearward of the pair of planar capacitors 40, 42 and the ferrite bead 44 lying between them.

Figure 2:
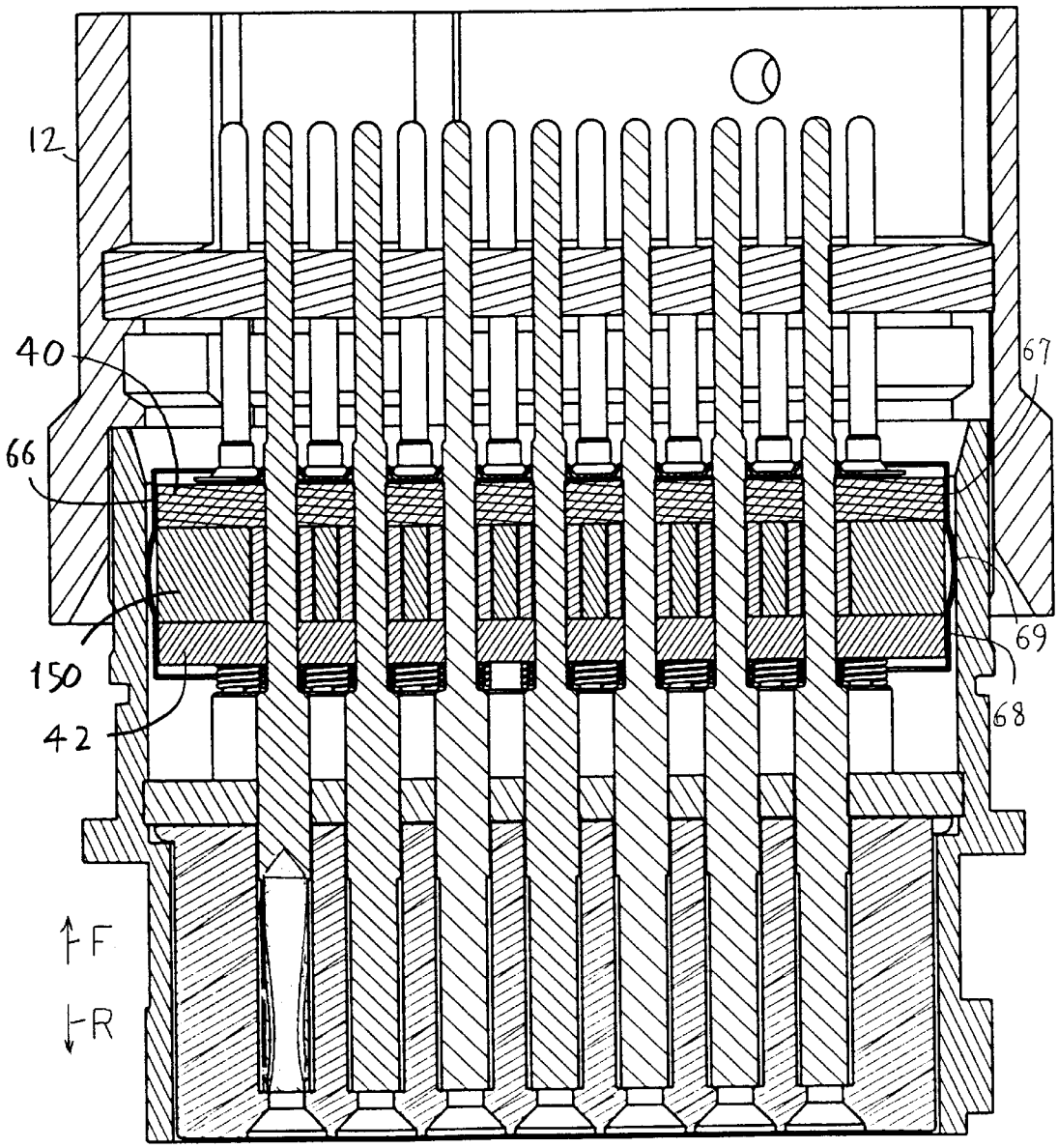
FIG. 2 is a sectional view of the connector of FIG. 1, but with a modification wherein a spacer spaces the planar capacitors.

Each planar capacitor includes at least one terminal 60, 61 that is to be connected to a location along the contact 20, and at least one other terminal 62 that is connected to a conductive peripheral band 64 lying at the periphery of the planar capacitor. FIGS. 1 and 2 show a spring contactor 66 that has forward and rearward arms 67, 68 that engage the peripheral bands of the two planar capacitors, and that has a center 69 that is biased against an inner surface of the grounded shell 12.

FIG. 3 shows that each planar capacitor 40, 42 has a plating 70, 72 on its holes 50, 52, with each plating connected to a planar capacitor terminal 60. Each hole plating includes a conductive layer 80, 82 on an outer face 84, 86 of the corresponding planar capacitor. The outer faces 84, 86 face away from each other, while inner faces 90, 92 face each other.

Each ferrite bead 44 provides inductance to a center part 100 of the contact middle portion 54, and each planar capacitor 40, 42 must be connected to location 102, 104 beyond opposite ends of the ferrite bead and preferably close to the planar capacitors. The connector elements that connect each hole plating 70, 72 to the contact should be short to avoid unwanted stray capacitance and inductance. In accordance with the present invention, applicant provides connector elements which are a coil spring 110 and a slidable retainer ring 112. The coil spring 110 connects one conductive layer 82 to a location 102 on the contact. The slideable retainer ring 112 connects the other planar layer 80 to another location 104 along the contact. As mentioned above the contact locations 102, 104 should lie near opposite ends of the ferrite bead 44, preferably no further from the corresponding capacitor layer 80, 82 than the average diameter of the contact (at C). Applicant also provides a thin flat washer 114 between each retaining ring 112 and each corresponding conductive layer 80 of the front planar capacitor. The coil springs and retainer rings each substantially contacts a conductive layer because there is either direct contact (the coil spring) or contact through a thin member (e.g. the flat washer 114) that is thinner along the connector axis than the coil spring and than the retainer ring.

Each contact is formed with its rear end 24 having a large diameter D, at least at a location adjacent to the middle contact portion 54. This results in a forwardly-facing shoulder 120 for abutting a first end 122 of a corresponding coil spring 110. The opposite second end 124 of the coil spring abuts a conductive layer 82. The middle contact portion 54 and front mating end 22 are both of smaller diameters than the outer diameter of the shoulder 120. The connector is assembled by inserting the front mating ends 22 and middle contact portions 54 through the holes of at least the rear planar capacitors, and through the holes in the ferrite beads 44. The contact front ends and parts of the middle contact portions are also projected through the first holes 50. The washers 114 are threaded around each contact, and the slideable retaining rings 112 are slid rearwardly along the front mating ends 22 and along the front ends of the middle contact portions to the locations 104 shown. Applicant prefers to have a front part 126 of the contact middle portion 54, of greater diameter than the mating end 22, to avoid scratching the mating end as the retaining ring is installed.

FIG. 5 shows the construction of one form of slidable retaining ring 112. The retaining ring has a conical part 130 and has a flat part 132 at the large end of the conical part. The smallest diameter end 134 of the retainer ring has a radially inner edge 136 that is deliberately kept sharp. The edge 136 may include burrs to help it dig into the metal contact. The retainer ring 112 can be easily slid along the forward mating end 22 and can be carefully slid along the front part 126 of the middle contact portion until the inner edge 136 of the retainer ring lies at the location 104, wherein the front planar capacitor 40 has been pushed towards the rear one to compress the coil spring 110. When rearward force is no longer applied to the retainer ring 112, it tends to cock, and one side of its sharp inner edge 136 digs into the location 104 on the contact to prevent the contact from moving rearward. Then, the coil spring presses tightly against the shoulder location 102 and the conductive layer 82, and the spring force presses the conductive layer 80 firmly against the washer 114 which passes against the flat end of the retainer ring 112. The edge 136 of the retainer ring remains firmly engage with the contact by reason of a side of its edge 136 cutting into the contact. The retainer ring extends at least ¾th of a circle (270°) about its axis, and preferably 360° about its axis.

The combination of the coil spring 110 and retainer ring 112 results in an easily installed contact which is securely held in place and which is connected in a low resistance and short length connection to the conductive layers 80, 82 of the two planar capacitors. The coil springs 110, which can be cylindrical, conical, or of other shape, are readily available at low cost, as are the flat washers 114 and slidable retainer rings 112. Applicant prefers to use coil springs 110 and slidable retainer rings 112 of steel, and flat washers 114 of highly conductive material such as a copper alloy, while the contacts are also preferably of a copper alloy. The copper alloy is softer than the material of the coil and ring.

In the filter connector of FIGS. 1 and 3, the planar capacitors 40,42 are spaced apart by the length of the ferrite beads 44. As shown in FIG. 3, the beads 44 are under compression force due to the compression of the coil springs 110. FIG. 2 shows a variation, wherein a spacer 150 is provided to separate the planar capacitors 40, 42 by slightly more than the lengths of the ferrite beads. The spacers have the advantage that they avoid compressive force on the ferrite beads. They also avoid the need to construct all ferrite beads with the same length, to avoid a large force on only a few ferrite beads of longest length. The ferrite beads can be delicate, and applying the force of many coil springs on a single bead can cause the bead to break. A disadvantage of the spacer 150 is that it occupies space that otherwise could be occupied by contacts or which could result in a smaller diameter connector, and it results in an added complexity in assembling the filter connector.

In a filter connector that applicant has designed, each contact (FIG. 3) had diameters A, B, C and D of 0.040 inch, 0.049 inch, 0.046 inch, and 0.078 inch, respectively. Each contact had a length of 1.50 inch.

Although a pi filter is shown, any processing or filter circuit that includes at least one planar circuit component (e.g. circuit board) with holes for contacts and conductive layers on opposite faces around the holes, can be constructed using applicant's coil springs and retainer rings.

Thus, the invention provides a filter connector and assembly method, which results in the contacts being securely held in position and securely electrically coupled to terminals of the planar capacitors, in a manner that resists mechanical shock and that resists damage by differential thermal expansion, and which enables assembly in a simple manner and using low cost and widely available parts. The contacts are each formed with a shoulder at one contact mating end, which abuts a coil spring that presses against a conductive layer along an outer face of one planar capacitor. A slidable retainer ring is provided that locks to the contact at the outer face of the other planar capacitor while keeping the coil spring compressed. The coil spring and retainer ring can each press directly against a plating on a corresponding planar capacitor, or compress and make contact through a flat washer or the like.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A filter connector that includes a conductive shell that has an axis, and front and rear planar capacitors lying within said shell and spaced apart along said axis, said planar capacitors having inner faces facing each other along said axis and outer faces facing away from each other, each planar capacitor having a plurality of holes and a conductive layer lying on each planar capacitor outer face around each hole therein, said connector also including a plurality of elongated contacts each projecting through one of said holes in each of said planar capacitors, each contact having a middle contact portion with a center part lying between said planar capacitors and each contact having front and rear ends extending respectively forward of said front planar capacitor and rearward of said rear planar capacitor, said connector including a plurality of ferrite beads each lying around the center portion of one of said contacts and between said planar capacitors, wherein:

said contacts each has a shoulder lying rearward of the rear planar capacitor and facing at least partially toward said rear planar capacitor; and including a plurality of retainer rings, each fixed to one of said contacts at a location forward of the front planar capacitor and lying adjacent to a conductive layer of said front planar capacitor;

a plurality of coil compression springs each lying around one of said contacts and having a first spring end lying substantially against one of said contacts shoulders and a second spring end lying substantially against a conductive layer of said rear planar capacitor;

said retainer rings being slideable along portions of said contact front ends and each retainer ring being fixed to a contact at a position adjacent to a corresponding front capacitor conductive layer and wherein the retainer ring holds the corresponding coil spring in compression to press the coil spring toward a corresponding one of said conductive layers.

2. The filter connector described in claim 1 wherein:

each of said retainer rings has a ring axis and extends at least 270° about the ring axis, and each of said retainer rings is of a type that has a flat end part and that has a cone-shaped part with a smallest end having a sharp radially inner edge and with an opposite largest end that merges with the flat end part, the sharp inner edge surrounding the contact to slide therealong and into a contact location forward of said forward planar capacitor, and the flat end part lying adjacently one of said conductive films.

3. The filter contact connector described in claim 1 including:

a flat metal washer lying between each retainer ring and each corresponding conductive layer.

4. The filter connector described in claim 1 wherein:

each of said contacts has a large outside diameter part extending along at least part of said rear end, each of said contacts has a small diameter along said front end, and each of said contacts has middle diameters that are between said large and small diameters along said middle portion, said middle portion extending rearward beyond said rear planar capacitor to form said shoulder at an intersection of said middle portion and said large diameter part, and said middle portion extending forward beyond said front planar capacitor to form a location where said retainer ring penetrates said contact, said location where said retainer ring penetrates being of larger diameter than said front end, whereby to avoid scratching said front end.

5. The filter connector described in claim 1 wherein:

said contact front end comprises a narrow pin mating portion extending along a majority of said front end, and said middle contact portion includes a retainer portion that extends between said front end and said center part, said retainer portion being shorter in length but larger in diameter than said front end, whereby to avoid scratching said pin mating portion during the sliding of a retainer ring therealong.

6. The filter connector described in claim 1 wherein:

each of said planar capacitors has a circular periphery and has a conductive peripheral band at its periphery;

a spring contactor extending around said bands and having forward and rearward resilient arms each pressed against one of said conductive peripheral bands, said contactor having a center pressed against an inside surface of said shell.

7. A filter connector that includes a conductive shell that has an axis, at least one planar circuit component lying within said shell and having outer faces facing away from each other and facing along said axis, said planar circuit component having a plurality of holes and having a conductive layer lying on each of said outer faces around each hole, said connector also including a plurality of elongated contacts projecting through said holes, and each contact having front and rear ends extending respectively forward and rearward of said planar circuit component, wherein:

said contacts each has a contact shoulder lying rearward of the planar circuit component and facing at least partially forward; and including a plurality of retainer rings, each fixed to one of said contacts at a location forward of the planar circuit component and lying substantially against and in electrical connection with a conductive layer on a first of said outer faces;

a plurality of coil compression springs each lying around one of said contacts and having a first spring end lying substantially against and in electrical connection with one of said contact shoulders and a second spring end lying substantially against and in electrical connection with a conductive layer on a second of said outer faces;

said retainer rings being slideable along portions of said contact front ends and each retainer ring being fixed to a contact at a position adjacent to a corresponding conductive layer, and each retainer ring holds the corresponding coil spring in compression to press the coil spring toward a corresponding one of said conductive layers.

8. A method for assembling a filter connector, comprising:

placing a coil spring around a front pin end of a contact and against a largely forwardly-facing shoulder of the contact, and sliding the front pin end forwardly through aligned holes of two parallel planar capacitors and a ferrite bead that lies between the capacitors, wherein the planar capacitors have opposite faces with a conductive layer on each opposite face in a region around each hole therein;

placing a retaining ring around the front pin end of the contact and sliding the retaining ring rearwardly along the front pin end, and pressing the contact forwardly to compress the coil spring until the retaining ring lies pressed substantially against a conductive layer on one planar capacitor while the coil spring is compressed substantially against a conductive layer on the other planar capacitor.

9. The method described in claim 8 including:

placing a flat metal washer between the retainer ring and the corresponding conductive layer.

* * * * *